United States Patent [19]

Pittman et al.

[11] Patent Number: 4,908,068

[45] Date of Patent: Mar. 13, 1990

[54] REMOVAL OF FIBROUS MATERIAL

[75] Inventors: John Pittman, Huddersfield; Enid Pittman, Cleckheaton, both of Great Britain

[73] Assignees: Ruth Coneglio; Ben Coneglio, both of Hannon, Canada

[21] Appl. No.: 113,246

[22] Filed: Oct. 26, 1987

[30] Foreign Application Priority Data

Oct. 25, 1986 [GB] United Kingdom ..... 8625602

[51] Int. Cl.[4] ..... D04H 1/64; B08B 15/00

[52] U.S. Cl. ..... 134/4; 252/315.2; 134/42; 134/25.1; 134/2; 106/125; 427/220; 427/422; 428/443

[58] Field of Search ..... 252/315.2, 315.1; 134/4

[56] References Cited

U.S. PATENT DOCUMENTS

| | | | |
|---|---|---|---|
| 3,943,220 | 3/1976 | Barnett | 264/103 |
| 4,347,150 | 8/1982 | Arpin | 134/4 X |
| 4,532,273 | 7/1985 | Kadowaki et al. | 523/402 |
| 4,632,847 | 12/1986 | Lomasney et al. | 134/4 X |
| 4,693,755 | 9/1987 | Erzinger | 134/4 |
| 4,699,666 | 10/1987 | Tidquist et al. | 134/4 |

*Primary Examiner*—Brooks H. Hunt
*Assistant Examiner*—Virginia B. Caress
*Attorney, Agent, or Firm*—Merchant, Gould, Smith, Edell, Welter & Schmidt

[57] ABSTRACT

There is disclosed a method of removing asbestos or other fibrous material from structures, such as the lagging on pipes, by injecting into the material a treatment liquid which includes a gelling agent and which sets to form a gel of which the fibrous material comprises an integral part, thereby allowing the material to be removed without generating hazardous fibrous dust.

6 Claims, No Drawings

REMOVAL OF FIBROUS MATERIAL

The present invention relates to an improved method of removing fibrous material and particularly, though not exclusively, to an improved method of removing asbestos material.

In recent years, asbestos, which had previously been extensively used as an insulating/fire proofing substance, has been identified as a serious health hazard. Currently, asbestos is therefore being removed and replaced by safer materials.

One of the problems which arises when asbestos is removed is that fine particles of the asbestos are released into the atmosphere. These are more dangerous than the larger pieces of asbestos, since they can be inhaled, causing serious health problems.

Conventionally, when removing asbestos, it is common practice to spray the material with water before removing it, so as to inhibit the formation of asbestos dust. This suffers from the disadvantage that the water evaporates, thus releasing asbestos dust again into the atmosphere.

According to a first aspect of the present invention there is provided a method of treating fibrous material to prevent the release of particles of the material when the material is removed by cutting, tearing or otherwise, the method comprising injecting into the fibrous material a liquid containing a gelling agent, and then allowing the injected liquid to set thereby forming a gel of which the fibrous material is an integral part.

Thus fibrous material treated according to the present invention may safely be removed by cutting, tearing or any other suitable method without releasing particles of the material into the atmosphere.

The fibrous material which may be treated can be any type of material, but typically it would be asbestos.

The preferred gelling agent is gelatine, and the liquid may be formed by dissolving gelatine powder, which may be industrial gelatine powder, in hot water and mixing thoroughly.

Preferably, the liquid is allowed to cool after mixing and is stored in a sealed container until required.

Preferably, the liquid is transferred into a second container prior to use, the liquid being heated whilst in the second container to render it less viscous.

Preferably, the liquid is injected under pressure into the fibrous material at various points through a specially designed nozzle.

Preferably, there are a number of different designs of nozzle to suit different types of fibrous material.

According to a second aspect of the present invention there is provided a liquid for treating fibrous material prior to removal by cutting, tearing or otherwise, the liquid containing a gelling agent which, when the liquid is injected into the fibrous material, sets to form a gel of which the fibrous material is an integral part.

One example of the present invention will now be described by way of example only, in order that the invention may be better understood.

Fibrous material, for example asbestos in the form of lagging around pipes, is treated prior to its removal by cutting, tearing or other suitable method, with a liquid comprising industrial gelatine powder dissolved in hot water. The amounts of gelatine and water used may vary, but a typical example is one third of an ounce of gelatine powder to one pint of water (9.5 grammes in 0.57 liters). The water is boiled, then allowed to cool slightly before mixing thoroughly with the powder.

Once mixed, the liquid can be stored in sealed containers until required, when it is tipped into a second container on site. The second container includes a heater which warms the liquid to render it less viscous so that it can be injected into the lagging.

After a few minutes warming, the liquid is injected under pressure through a specially designed nozzle into the lagging at various points. When the injectionis complete, the treated lagging is left for a period of time, typically 24 hours, to set into a gel, after which time it may be removed by any suitable method without any risk of asbestos particles being released into the atmosphere.

An embodiment of the method of the present invention will now be described by way of example only, with reference to the accompanying drawings in which.

Figure 1:
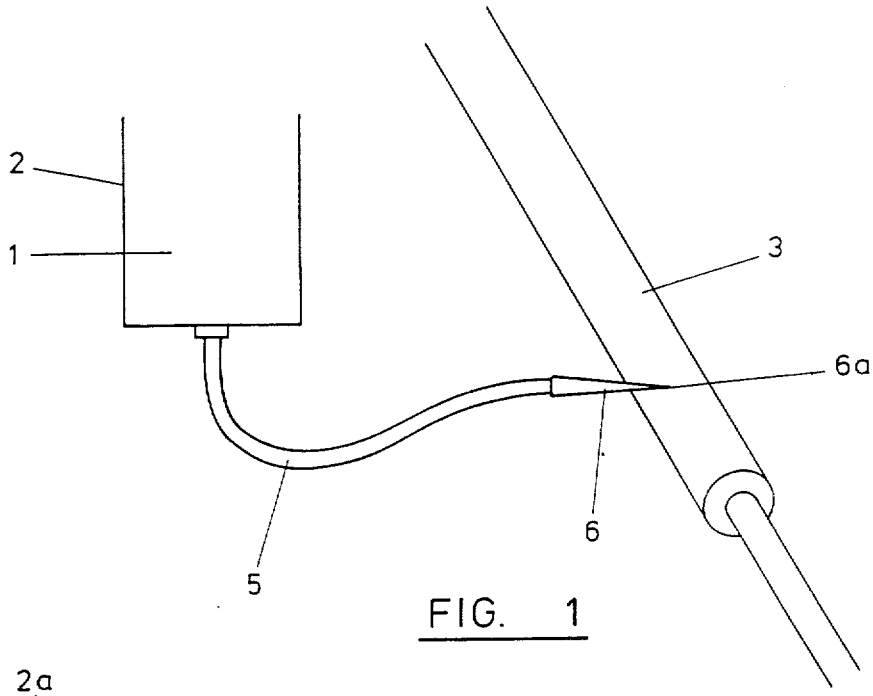
FIG. 1 is a schematic drawing showing the method of the present invention.

Referring to the drawings, the method in accordance with the present invention comprises injecting a liquid 1 from a container 2 into fibrous material 3, for example asbestos lagging surrounding a pipe 4. The liquid is injected through a hose or pipe 5 and a nozzle 6 which has a tapering end *6a* for inserting in the fibrous material. The shape of the nozzle is designed to suit the characteristics of the particular material to be treated, and there may even be provided a range of differently shaped nozzles for different applications.

The liquid is made up by dissolving an amount of gelatine powder in hot water and mixing thoroughly, typical proportions being 9.5 grammes in 0.57 liters. The liquid is then allowed to cool and is stored in a sealed container *2a* until it is required to be used.

Because the liquid becomes quite viscous, it requires to be heated before use to render it flowable, and this is conveniently achieved by transferring the liquid from the sealed container 2 to a second container 7 from whence it is injected into the material. Whilst in the second container 7 it is heated by applying heat from a heat source 8, which heat source may also be an integral part of the second container 7.

When it is required to strip fibrous material from a surface, such as a concrete surface or steelwork, it is sometimes the case that adhesives have been used, or bitumen, to adhere the fibrous material to the surface. Therefore, to facilitate the removal of the fibrous material in such circumstances, it may be advantageous to include in the treatment liquid a solvent or agent which is reactive with the adhesive or bitumen. One example comprises a paraffin wax type product obtained from Shaw Chemicals and known as YLA BETALUBE. This breaks down bitumen, and oil-based resins, and also imparts a more acceptable colour to the treatment liquid.

We claim:

1. A method of treating fibrous material to prevent the release of particles of the material when the material is removed by cutting, tearing or otherwise, the method comprising injecting into the fibrous material a liquid containing a gelatine, and then allowing the injected liquid to set thereby forming a gel of which the fibrous material is an integral part.

2. A method according to claim 1, in which the material is asbestos.

3. A method according to claim 1, in which the liquid is formed by dissolving gelatine powder in hot water and mixing thoroughly.

4. A method according to claim 3, in which the liquid is allowed to cool after mixing and is stored in a sealed container until required.

5. A method according to claim 4, in which the liquid is transferred into a second container prior to use, the liquid being heated whilst in the second container to render it less viscous.

6. A method according to claim 1, in which the liquid is injected under pressure into the fibrous material at various points through a nozzle.

* * * * *

UNITED STATES PATENT AND TRADEMARK OFFICE

CERTIFICATE OF CORRECTION

PATENT NO. : 4,908,068

DATED : Mar. 13,1990

INVENTOR(S) : John Pittman, Enid Pittman

Figure 2:
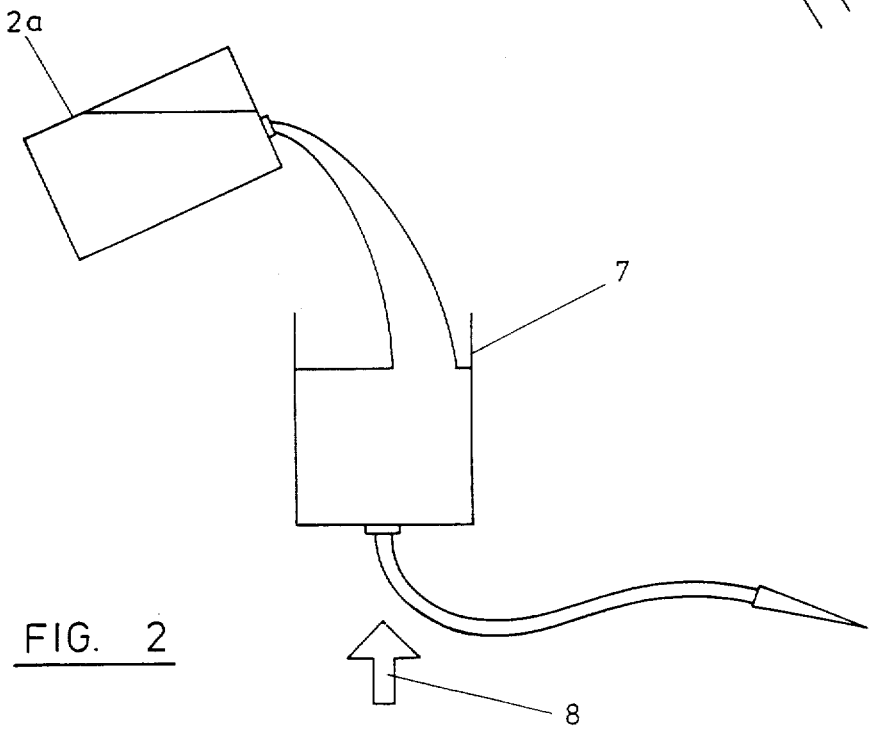
FIG. 2 is a schematic drawing showing the transfer of the liquid from a first to a second container and subsequent heating of the second container.

It is certified that error appears in the above-identified patent and that said Letters Patent is hereby corrected as shown below:

The sheet of Drawing consisting of Figures 1 and 2 should be added as per attached sheet.

Signed and Sealed this

Twenty-eighth Day of August, 1990

*Attest:*

HARRY F. MANBECK, JR.

*Attesting Officer*

*Commissioner of Patents and Trademarks*